US008474508B2

(12) United States Patent
Cha

(10) Patent No.: US 8,474,508 B2
(45) Date of Patent: Jul. 2, 2013

(54) BLIND AND MANUFACTURING METHOD THEREOF

(76) Inventor: Ki Cheol Cha, Daegu (KR)

( * ) Notice: Subject to any disclaimer, the term of this patent is extended or adjusted under 35 U.S.C. 154(b) by 135 days.

(21) Appl. No.: 13/033,445

(22) Filed: Feb. 23, 2011

(65) Prior Publication Data

US 2011/0209833 A1 Sep. 1, 2011

(30) Foreign Application Priority Data

Feb. 27, 2010 (KR) ..... 10-2010-0018270

(51) Int. Cl.
*E06B 9/303* (2006.01)

(52) U.S. Cl.
USPC ..... 160/176.1 R; 160/177 R; 160/178.3; 139/384 A

(58) Field of Classification Search
USPC ..... 160/84.05, 176.1 R, 177 R, 178.3; 138/384 A
See application file for complete search history.

(56) References Cited

U.S. PATENT DOCUMENTS

| | | | | |
|---|---|---|---|---|
| 6,164,363 | A * | 12/2000 | Colson et al. | 160/84.05 |
| 7,055,572 | B2 * | 6/2006 | Nien et al. | 160/178.3 |
| 7,614,438 | B2 * | 11/2009 | Yu et al. | 160/176.1 R |
| 2004/0084158 | A1 * | 5/2004 | Colson et al. | 160/84.05 |
| 2011/0209833 | A1 * | 9/2011 | Cha | 160/84.01 |
| 2012/0085504 | A1 * | 4/2012 | Cha | 160/236 |

FOREIGN PATENT DOCUMENTS

| | | | |
|---|---|---|---|
| KR | 100911052 | B1 | 7/2009 |
| KR | 100912862 | B1 | 8/2009 |
| KR | 100932651 | B1 | 12/2009 |

* cited by examiner

*Primary Examiner* — Blair M. Johnson

(57) ABSTRACT

Provided is a blind including a light-shielding sheet 20 having an internal space 22; a connecting string 30 which is received in the internal space 22; and an adjusting string 40 which is connected so as to alternately enclose an outer surface of the connecting string 30. Therefore, the blind has improved functionality and usability.

6 Claims, 8 Drawing Sheets

BLIND AND MANUFACTURING METHOD THEREOF

CROSS-REFERENCE(S) TO RELATED APPLICATIONS

The present invention claims priority of Korean Patent Application No. 10-2010-0018270, filed on Feb. 27, 2010, which is incorporated herein by reference.

BACKGROUND OF THE INVENTION

1. Field of the Invention

The present invention relates to a blind and a manufacturing method thereof, and particularly to a blind which can selectively shield the light using a light-shielding sheet, and a manufacturing method thereof.

2. Description of Related Art

Generally, a blind is disposed at the window and entrance of a building and functions to shade the light. Further, a decoration function is recently added to the blind besides the light-shielding functions, and thus the blind has various shapes.

A light-shielding degree of the blind can be adjusted by an opening state thereof.

A conventional blind includes a light-shielding sheet, and a string which opens and closes the light-shielding sheet through a pulling operation so as to control the light-shielding degree. The structure of the conventional blind is disclosed in Korean Patent Nos. 0911052 and 0912862.

In the conventional blind, the string is densely formed at the light-shielding sheet or the string is thermally bonded to the light-shielding sheet in order to interlock the light-shielding sheet with an operation of the string.

However, in case that the string is formed at the light-shielding sheet, if excessive force is exerted to the string, troubles may occur in the forming state of the string and light-shielding sheet, and the string may be separated. Also, in case that the string is thermally bonded to the light-shielding sheet, since a bonding surface area between the string and light-shielding sheet is relatively small, the bonded portions may be separated from each other due to excessive force or external temperature change and thus the string may be malfunctioned.

Since the string is made of a single yarn, there is a strong possibility that the string is cut when the excessive force is applied or it is used for a long time period. Further, since a connection portion of the string is exposed to an outside, it is undesirable for the sake of appearance.

Accordingly, it leads to deterioration of functionality, usability and decoration ability of the blind.

SUMMARY OF THE INVENTION

An embodiment of the present invention is directed to providing a blind which can strongly and stably maintain the connection between the string and the light-shielding sheet and also in which the connection portion thereof is not exposed to the outside, and a manufacturing method thereof.

To achieve the object of the present invention, the present invention provides a blind including a light-shielding sheet having an internal space; a connecting string 30 which is received in the internal space; and an adjusting string which is passed through the internal space and then connected with the connecting string, wherein the adjusting string includes multiple strands which are connected so as to alternately enclose an outer surface of the connecting string, and the connecting string is interlocked with the adjusting string through a pulling operation so as to control an opening and closing state of the light-shielding sheet.

Preferably, the connecting string is provided in plural so as to be parallel upward and downward to each other in the internal space.

Preferably, the adjusting string includes a first string and a second strings which are connected so as to alternately enclose the outer surface of the connecting string.

Preferably, the adjusting string is located at a rear side of the light-shielding sheet.

Preferably, multiple warps forming the light-shielding sheet are divided into two directions at a lower region thereof, and the ends of the divided warps are woven so as to form the internal space.

Further, the present invention provides a manufacturing method of a blind, including forming an internal space at a light-shielding sheet; supplying an adjusting string having multiple strands into the internal space; supplying a connecting string into the internal space; and weaving the adjusting string so as to alternately enclose an outer surface of the connecting string.

Preferably, the connecting string is provided in plural so as to be parallel to each other upward and downward in the internal space, and then woven so as to alternately enclose the outer surface of each of the multiple connecting strings.

Preferably, the adjusting string includes a first string and a second string, and one of the multiple connecting strings passes in turn a front side of the first string and a rear side of the second string and then the first and second strings are alternated with each other, and neighboring another one passes in turn the rear side of the second string and the front side of the first string and then the first and second strings are alternated with each other, and the weaving is carried out by repeating this process.

DETAILED DESCRIPTION OF MAIN ELEMENTS

| | |
|---|---|
| 20: light-shielding sheet | 22: internal space |
| 30: connecting string | 40: adjusting string |
| 42: first string | 44: second string |
| 50: mesh net | |

DESCRIPTION OF SPECIFIC EMBODIMENTS

The advantages, features and aspects of the invention will become apparent from the following description of the embodiments with reference to the accompanying drawings, which is set forth hereinafter.

Figure 1:
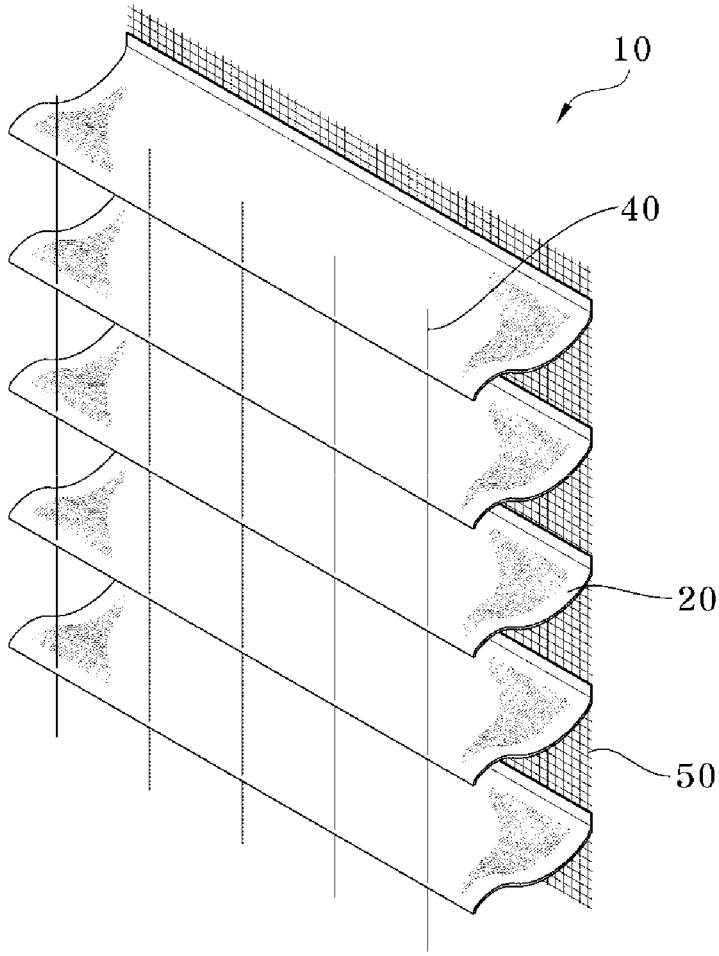
FIG. 1 is a perspective view of a blind according to the present invention.
Figure 2:
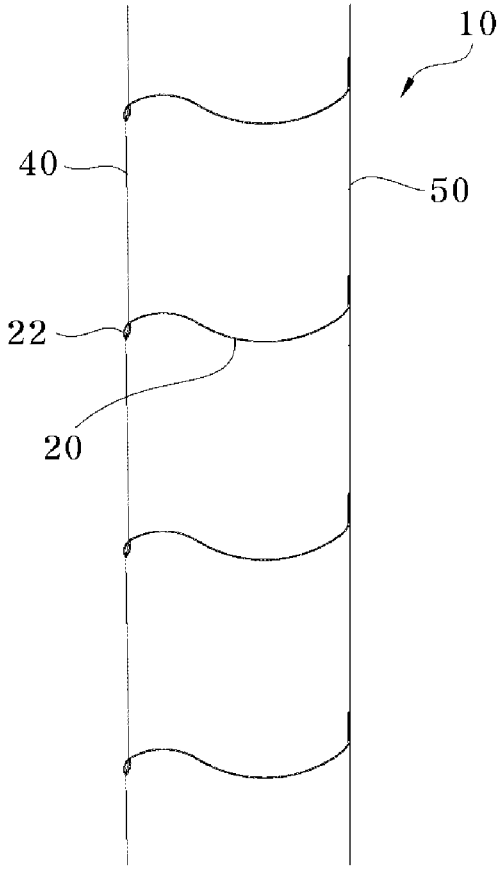
FIG. 2 is a side view of the blind according to the present invention.
Figure 3:
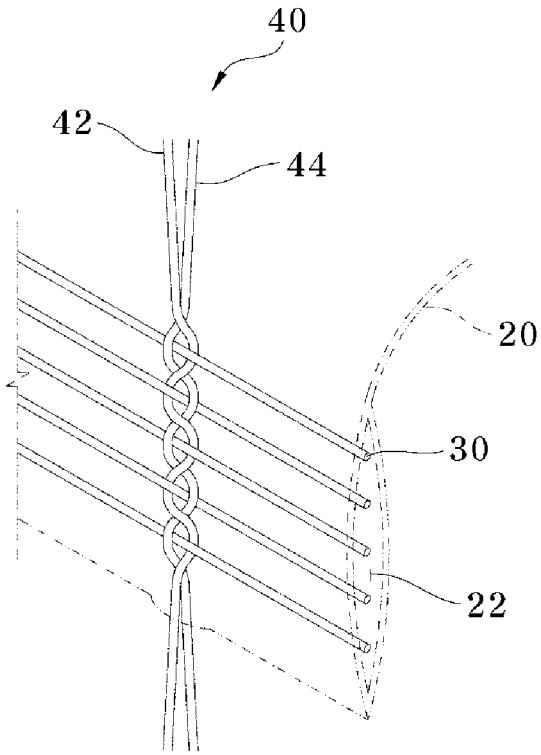
FIG. 3 is a perspective view of a connection structure of an adjusting string and a connecting string of the blind according to the present invention.

As shown in FIGS. 1 to 3, a blind 10 of the present invention includes a light-shielding sheet 20 having an internal space 22; a connecting string 30 which is received in the internal space 22 of the light-shielding sheet 20; and an adjusting string 40 which is passed through the internal space 22 of the light-shielding sheet 20 and then connected with the connecting string 30.

The light-shielding sheet 20 is formed of fabrics, and functions to shield external light.

The light-shielding sheet 20 is formed into a rectangular shape and provided in plural to be in parallel upward and downward. An upper end of the light-shielding sheet 20 is firmly fixed to a mesh net 50 having a mesh structure so as to allow an opening/closing operation of the light-shielding sheet 20.

Meanwhile, the number, material and arrangement of the light-shielding sheet 20 may be changed properly as necessary.

The internal space 22 formed in the light-shielding sheet 20 is to prevent separation of the connecting string 30, and the internal space 22 is formed to be elongated along a lower edge of the light-shielding sheet 20. Multiple warps forming the light-shielding sheet 20 are divided into two directions at a lower region thereof, and the ends thereof are woven with wefts of the light-shielding sheet 20 so that the internal space 22 is formed. Of course, the wefts are densely woven with the bidirectional warps.

Further, various methods for forming the internal space 22 can be selectively used as necessary. For example, in a state that a lower portion of the light-shielding sheet 20 is folded upward, an end of the folded portion may be fixed by a weaving process and the like, or a separate fabric may be connected to the lower portion of the light-shielding sheet 20 so as to form the internal space 22.

Owing to the formation of the internal space 22 in the light-shielding sheet 20, it is possible to stably maintain the center of gravity and also it is prevented that the connection portion of the connecting string 30 and the adjusting string 40 is exposed to the outside, thereby improving the whole appearance of the blind 10.

The connecting string 30 is interlocked with the adjusting string 40 so as to control the opening and closing operation of the light-shielding sheet 20. The connecting string 30 is arranged along the internal space 22 of the light-shielding sheet 20.

The connecting string 30 is disposed to be at right angles to the adjusting string 40. That is, the connecting string 30 is disposed horizontally, and the adjusting string 40 is disposed vertically.

Preferably, the connecting string 30 is disposed to be parallel upward and downward in the internal space 22 of the light-shielding sheet 22 in order to stably and firmly maintain the connection state with the adjusting string 40.

Meanwhile, the connecting string 30 is formed of a material having excellent physical properties such as durability. Various kinds of connecting strings may be selectively applied.

The adjusting string 40 includes a first string 42 and a second string 44 which are connected so as to alternately enclose an outer surface of the connecting string 30. The adjusting string 40 moves up and down the connecting string 30 through a pulling operation, thereby controlling the opening and closing state of the light-shielding sheet 20.

The adjusting string 40 including the first and second string 42 and 44 is just an example. The number of adjusting strings 40 may be changed within an extent which can firmly maintain the connection state with the connecting string 30.

Figure 4:
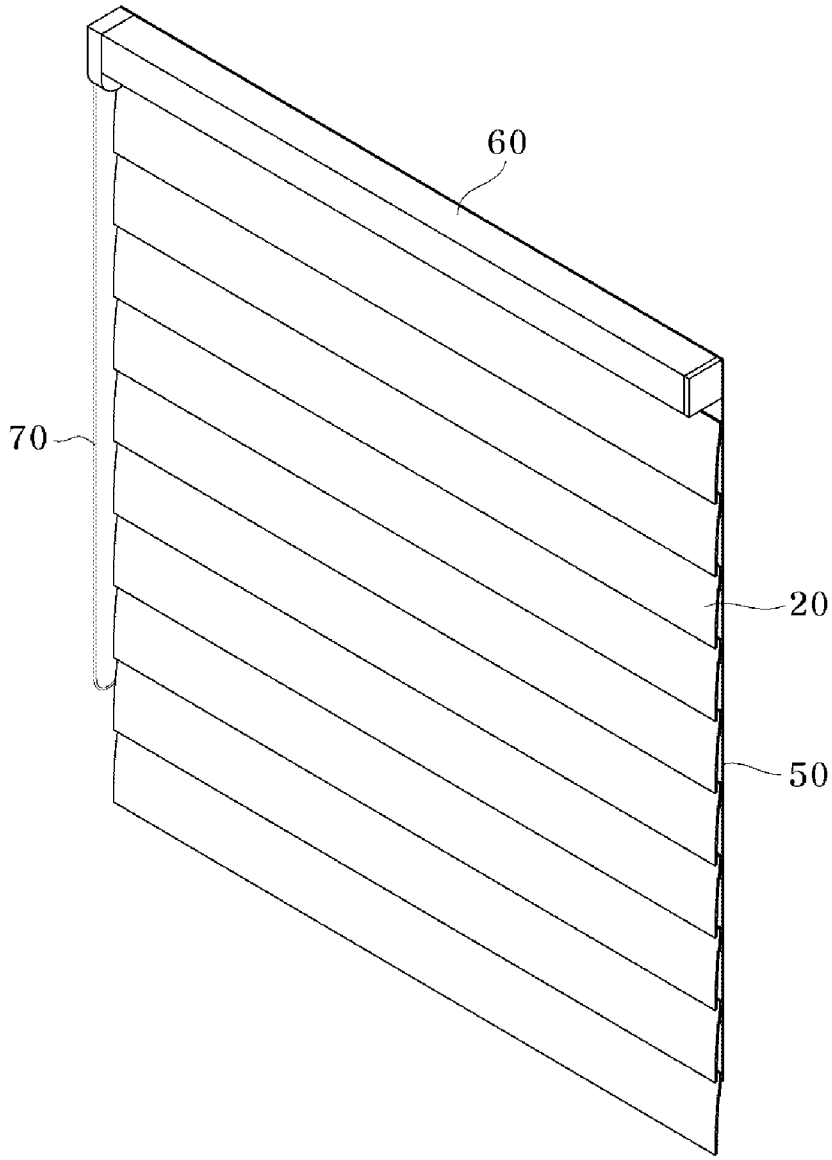
FIG. 4 is a perspective view showing a state that the adjusting string of the blind is disposed at a rear side of a light-shielding sheet according to the present invention.
Figure 5:
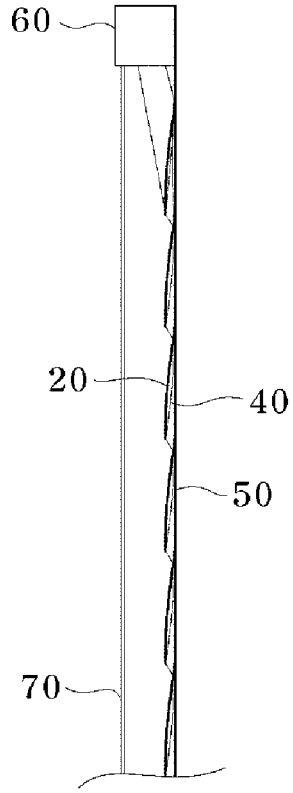
FIG. 5 is a side view of FIG. 4.
Figure 6:
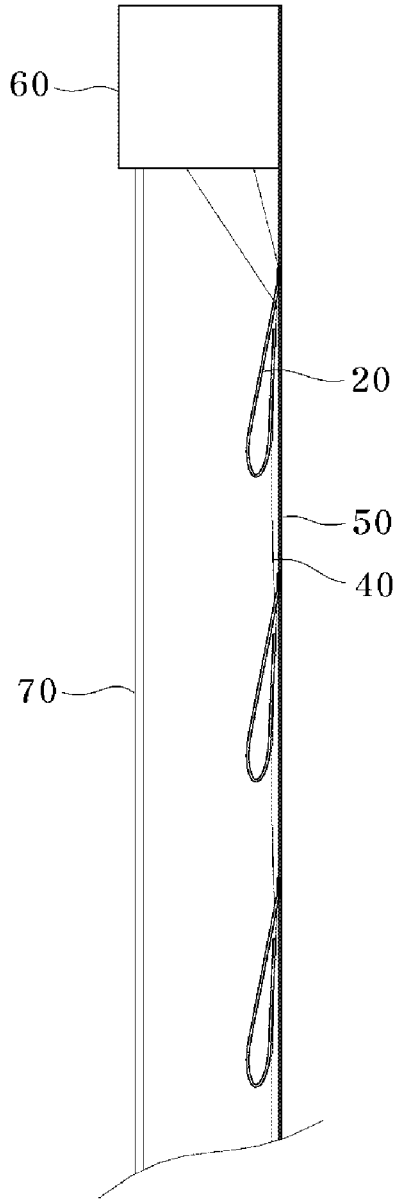
FIG. 6 is a view showing an operation state of FIG. 4.

The adjusting string 40 is disposed at a front side of the light-shielding sheet 20 so that the lower portion of the light-shielding sheet 20 is lifted up toward the front side by the pulling operation of the adjusting string 40. As shown in FIGS. 4 and 6, in case that the adjusting string 40 is located at a rear side of the light-shielding sheet 20 that the mesh net 50 is attached, the lower portion of the light-shielding sheet 20 is lifted up toward the rear side by the pulling operation.

Meanwhile, reference numerals 60 and 70 which are not explained are a control box which is coupled to an upper end of the blind, and a lifting code which is disposed at a side surface of the control box so as to control the opening and closing operation of the blind 10.

Hereinafter, operation process of the blind will be described.

If the adjusting string 40 is pulled in a state that the light-shielding sheet 20 is closed, the connecting string 30 connected with the adjusting string 40 is moved up, and thus the light-shielding sheet 20 is slowly opened from the lower portion thereof.

On the contrary to this, if the adjusting string 40 is pulled in a state that the light-shielding sheet 20 is opened, the connecting string 30 connected with the adjusting string 40 is moved down, and thus the light-shielding sheet 20 is slowly closed.

Herein, since the connecting string 30 is received in the internal space 22 formed at the light-shielding sheet 20, it is possible to naturally open and close the light-shielding sheet 20 according to the movement of the connecting string 30.

Figure 7:
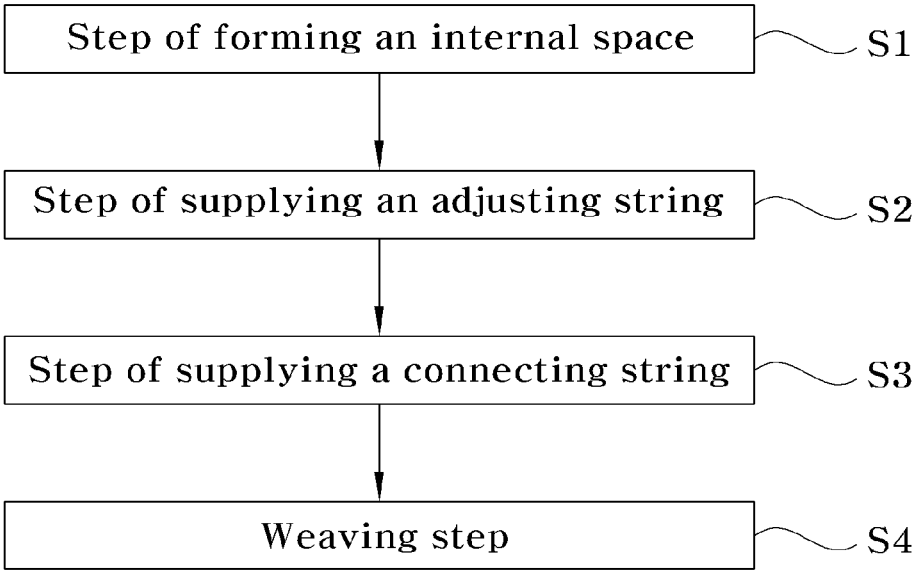
FIG. 7 is block diagram showing a manufacturing method of the blind according to the present invention.

FIG. 7 is block diagram showing a manufacturing method of the blind according to the present invention.

① A first step (S1): forming the internal space 22 at the light-shielding sheet 20 formed of fabric.

Herein, multiple warps forming the light-shielding sheet 20 are divided into two directions at a lower region thereof, and the ends thereof are woven with wefts of the light-shielding sheet 20 so that the internal space 22 is formed. The wefts are densely woven with the bidirectional warps.

② A second step (S2): supplying the adjusting string 40 having multiple strands into the internal space 22 of the light-shielding sheet 20.

Herein, the adjusting string 40 includes the first and second strings 42 and 44. The first and second strings 42 and 44 are supplied in the same direction (vertical direction) as a direction of the warp of the light-shielding sheet 20.

③A third step (S3): supplying the connecting string 30 into the internal space 22 of the light-shielding sheet 20.

Herein, the multiple strands of the connecting string 30 are provided in the same direction (horizontal direction) as a direction of the weft of the light-shielding sheet 20 so as to be in parallel and at regular intervals.

④A fourth step (S4): weaving the adjusting string 40 so as to alternately enclose the outer surface of the connecting string 30.

In the step, one of the multiple connecting strings 30, which is located at the uppermost portion, passes in turn a front side of the first string 42 and a rear side of the second string 44 and then the first and second strings 42 and 44 are alternated with each other. And another one, which is located at a lower side thereof to be adjacent to the upper most one, passes in turn the rear side of the second string 44 and the front side of the first string 42 and then the first and second strings 42 and 44 are alternated with each other. This process is repeatedly performed so that the weaving is firmly carried out.

Due to the connection structure between the adjusting string 40 and the connecting string 30, the connection state thereof can be stably maintained.

Meanwhile, the alternating of the first and second strings 42 and 44 is performed by using a special heald. If the first and second strings 42 and 44 are previously alternated with each other using the special heald before being coupled to the connecting string 30 which is located at the uppermost portion, the connection state between the adjusting string 40 and the connection string 30 can be achieved more firmly.

Figure 8:
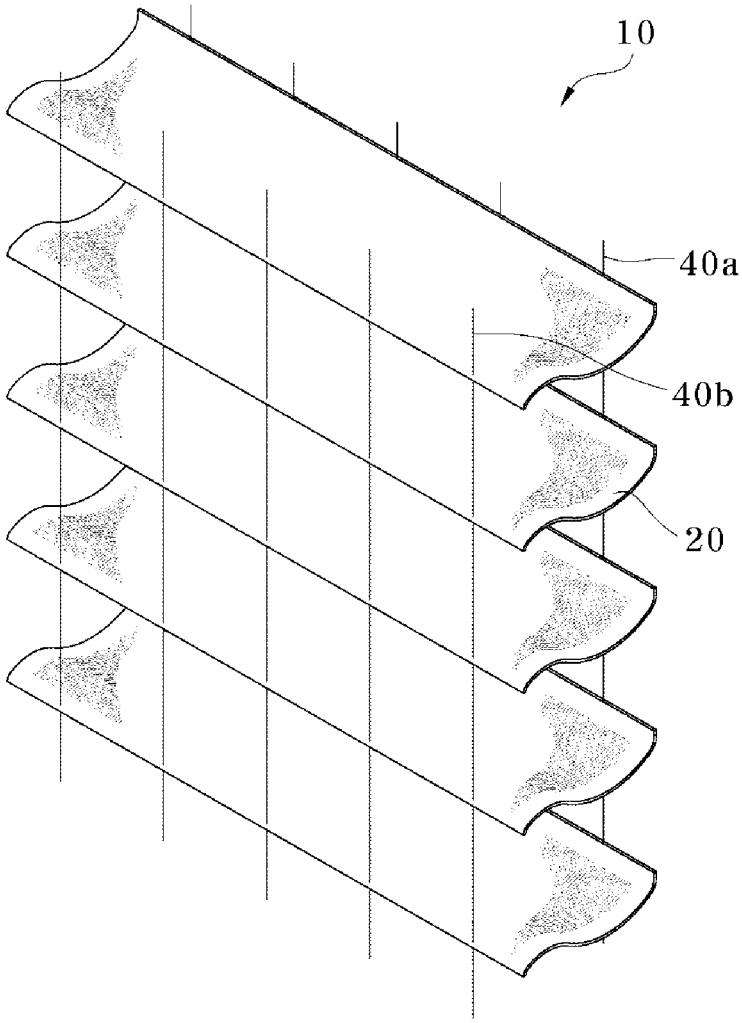
FIG. 8 is a perspective view of a blind according to another embodiment of the present invention.

FIG. 8 is a perspective view of a blind according to another embodiment of the present invention.

In the blind 10, as shown in the drawing, the light-shielding sheet 20 is disposed up and down to be spaced at regular intervals, and a pair of adjusting strings 40*a* and 40*b* is closely connected to both ends of the light-shielding sheet 20.

The blind 10 can control an opening and closing direction of the light-shielding sheet 20 using the adjusting strings 40*a* and 40*b*. However, since the connection structure of the adjusting strings 40*a* and 40*b* and other technical constructions are the same as that shown in FIGS. 1 to 3, the detailed description thereof will be omitted.

According to the present invention, since the adjusting string is arranged so as to alternately enclose an outer surface of the connecting string 30, it is possible to stably and firmly maintain the connection state thereof.

Particularly, in case that the connecting string is provided in plural, it is possible to further reinforce the connection state of the adjusting string.

And since the connection portion between the adjusting string and the connecting string is disposed in the internal space of the light-shielding sheet and the adjusting string is located at the rear side of the light-shielding sheet, it is possible to enhance the appearance of the blind.

Further, since the manufacturing method of the blind is very simple, it is possible to enhance productivity and economic feasibility.

While the present invention has been described with respect to the specific embodiments, it will be apparent to those skilled in the art that various changes and modifications may be made without departing from the spirit and scope of the invention as defined in the following claims.

What is claimed is:

1. A blind comprising:

a light-shielding sheet having an internal space;

a connecting string which is received in the internal space; and an adjusting string which is passed through the internal space and connected with the connecting string in the internal space, wherein the connecting string is interlocked with the adjusting string in such a manner that movement of the light-shielding sheet between an opened and closed state is controlled by adjusting the adjusting string.

2. The blind of claim 1, wherein the connecting string is provided in plural so as to be parallel to each other in the internal space.

3. The blind of claim 1, wherein the adjusting string comprises a first string and a second string which are arranged in a complementary manner so that the adjusting string is interlocked with the connecting string.

4. The blind of claim 2, wherein the adjusting string comprises a first string and a second string which are arranged in a complementary manner so that the adjusting string is interlocked with the connecting string.

5. The blind of claim 1, wherein the adjusting string is located at a rear side of the light-shielding sheet.

6. A blind comprising:

a light-shielding sheet having an internal space;

a connecting string which is received in the internal space; and an adjusting string which is passed through the internal space and connected with the connecting string in the internal space, wherein the connecting string is interlocked with the adjusting string in such a manner that movement of the light-shielding sheet between an opened and closed state is controlled by adjusting the adjusting string, and wherein multiple warps forming the light-shielding sheet are divided into two directions at a lower region thereof, and the ends of the divided warps are woven so as to form the internal space.

* * * * *